252-99 AU 166 EX
4/22/80 XR 4,199,465

United States Patent [19]
Rodriguez

[11] 4,199,465
[45] Apr. 22, 1980

[54] LAUNDRY DETERGENT SUBSTRATE ARTICLES

[75] Inventor: Victor F. Rodriguez, Cincinnati, Ohio

[73] Assignee: The Procter & Gamble Company, Cincinnati, Ohio

[21] Appl. No.: 864,136

[22] Filed: Dec. 23, 1977

[51] Int. Cl.[2] ..... C11D 1/62; C11D 1/835

[52] U.S. Cl. ..... 252/91; 252/99; 252/108; 252/109; 252/155; 252/523; 252/524; 252/525; 252/528; 252/529; 252/530; 252/541; 252/542; 252/544; 252/547; 252/548; 428/279; 252/174.15; 252/174.16; 252/174.21

[58] Field of Search ..... 252/8.8, 8.9, 89, 91, 252/132, 541, 542, 547, 99, 108, 109, 155, 523, 524, 525, 528, 529, 530, 544, 548; 428/279; 427/242

[56] References Cited

U.S. PATENT DOCUMENTS

| | | | |
|---|---|---|---|
| 2,702,780 | 2/1955 | Lerner | 424/25 |
| 2,950,253 | 8/1960 | Kling et al. | 252/547 X |
| 3,607,763 | 9/1971 | Salmen | 252/528 |
| 3,686,025 | 8/1972 | Russell | 252/91 X |
| 3,954,642 | 5/1976 | Schwuger | 252/91 |
| 3,956,155 | 4/1976 | Schwuger | 252/91 |
| 3,958,059 | 5/1976 | Diehl | 428/260 |
| 3,959,155 | 5/1976 | Montgomery | 252/8.8 |
| 3,959,157 | 5/1976 | Inamorato | 252/8.8 |
| 3,974,076 | 8/1976 | Wiersema et al. | 252/8.8 |

FOREIGN PATENT DOCUMENTS

| | | |
|---|---|---|
| 662710 | 4/1965 | Belgium . |
| 873214 | 7/1961 | United Kingdom . |

*Primary Examiner*—P. E. Willis, Jr.
*Attorney, Agent, or Firm*—Robert B. Aylor; Richard C. Witte; Thomas H. O'Flaherty

[57] ABSTRACT

Nonbleeding substrate articles, containing mixtures of cationic and nonionic surfactants, which yield excellent removal of particulate and greasy/oily soils from fabrics, and wherein the detergent components are rapidly and completely released into the laundry solution, are disclosed. A method of laundering fabrics using these articles is also disclosed.

37 Claims, No Drawings

LAUNDRY DETERGENT SUBSTRATE ARTICLES

BACKGROUND OF THE INVENTION

The present invention relates to laundry substrate articles, yielding excellent removal of particulate and greasy/oily soils, which contain mixtures of specific types of nonionic and cationic surfactants. These articles are formulated so as to increase the rate at which the nonionic/cationic surfactant mixture is released into the washing solution, thereby maximizing the cleaning benefit obtained, and to minimize the bleeding of the surfactant components from the substrate material.

The convenience and efficiency which is obtained by incorporating premeasured amounts of laundry detergent compositions into substrate articles, for direct addition to the automatic washing machine, are well known. Examples of such articles are taught in U.S. patent application Ser. No. 781,378, Flesher et al, filed Mar. 25, 1977; U.S. Pat. No. 4,095,946 Jones et al, issued June 20, 1978; U.S. Pat. No. 4,118,525, Jones, issued Oct. 3, 1978; and U.S. Pat. No. 4,113,630, Hagner et al, issued Sept. 12, 1978, all of the disclosures of which are incorporated herein by reference. In addition, U.S. patent application Ser. No. 811,220, Murphy, filed June 29, 1977, and U.S. patent application Ser. No. 811,221, Cockrell, filed June 29, 1977, both of which are incorporated herein by reference, disclose detergent compositions, containing mixtures of specifically defined nonionic and cationic surfactants, which yield outstanding removal of particulate and greasy/oily soils. It would be very desirable to combine the outstanding cleaning performance of these detergent compositions with the convenience of the substrate articles.

In order to combine these two technologies, several problems must be overcome. It is necessary to provide for rapid and complete release of the surfactant mixture from the substrate into the laundry solution, in order both to maximize the cleaning benefits obtained during the relatively short automatic laundering cycle, and to minimize waste of the surfactant components. Further, it is desirable to minimize the bleeding of the surfactant mixture, particularly the nonionic component, through the substrate sheets, which may occur during storage of the articles. It has now been found that the release of the nonionic/cationic surfactant mixtures into the laundry solution can be greatly increased by using the specific types of solubilization aids defined herein. It has further been found that the bleeding of the detergent components can be controlled by including the specific materials, having the required particle sizes, disclosed herein in the substrate articles.

It is, therefore, an object of the present invention to define a laundry substrate article providing excellent cleaning and which may also provide fabric care benefits, such as static control, fabric softening, and dye transfer inhibition, to the laundered fabrics.

It is another object of the present invention to provide a substrate article having improved release of its active components into the wash solution.

It is a further object of the present invention to provide a laundry substrate article wherein the bleeding of active components through the substrate sheets is minimized but which also exhibits proper release of the active components into the washing solution.

It is yet another object of the present invention to provide a process for laundering fabrics using the substrate articles described herein.

SUMMARY OF THE INVENTION

The present invention relates to substrate articles, used in the laundering of fabrics, which exhibit improved release of their active components into the washing solution, and which minimize bleeding of the surfactant components from the substrate material, consisting essentially of a water-insoluble, wet-strength substrate, carrying an effective amount of a detergent composition comprising:

(a) from about 5 to about 95% of a surfactant mixture consisting essentially of:

(i) a nonionic surfactant having an HLB of from about 5 to about 17; and (ii) a cationic surfactant having the formula $R_m{}^1R_x{}^2Y_LZ$, wherein each $R^1$ is an organic group containing a straight or branched alkyl or alkenyl group optionally substituted with up to 3 phenyl groups and, optionally, interrupted by up to 4 structures each of which is selected from the group consisting of

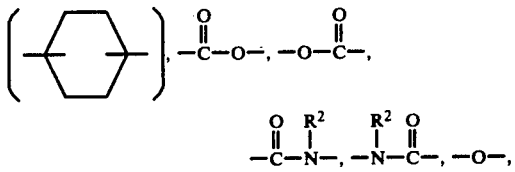

and mixtures thereof, and which contain from about 8 to about 22 carbon atoms, and which may additionally contain up to 20 ethoxy groups, m is a number of from 1 to 7 and no more than one $R^1$ can have more than 12 carbon atoms when m is 3 or greater, each $R^2$ is an alkyl or hydroxy alkyl group containing from 1 to 4 carbon atoms or a benzyl group with no more than one $R^2$ in a molecule being benzyl, x is a number from 0 to 7, the remainder of any carbon, nitrogen, sulfur or phosphorus atom positions being filled by hydrogens, Y is selected from the group consisting of:

(1)

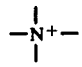

(2)

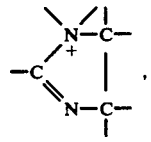

(3)

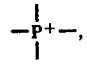

(4)

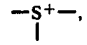

(5)

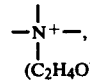

, wherein p is from 1 to 20,

-continued (6)

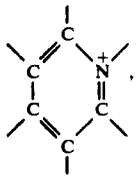

(7)

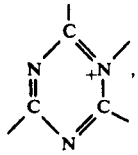

, and mixtures thereof, (8)

L is a number of from 1 to 3, Z is an anion in a number sufficient to give electrical neutrality, said cationic surfactant being at least water-dispersible in admixture with said nonionic surfactant; the ratio of said nonionic surfactant to said cationic surfactant being in the range of from about 5:3 to about 300:1, (b) from about 1% to about 30% of a nonionic or cationic solubilization aid which has a solubility in 100° F. water of at least about 20% by weight, and which completely dissolves in 100° F. water in no more than about 2 minutes; and (c) from about 2 to about 20% of an anti-bleeding material, selected from the group consisting of silicas, clays, amides, soaps, and mixtures thereof, having an average particle size of no greater than about 3.0 microns.

Preferred anionic surfactants are those having the formula $R(OC_2H_4)_nOH$, wherein R is a primary or secondary alkyl chain of from about 8 to about 22 carbon atoms and n is an average of from about 2 to about 9.

The articles herein may also contain various optional adjunct materials commonly employed in laundry detergent compositions.

A method of laundering fabrics, utilizing the articles of the present invention, is also taught herein.

DETAILED DESCRIPTION OF THE INVENTION

Substrate Component

The articles of the present invention comprise a water-insoluble, wet-strength substrate carrying an effective amount of a detergent composition, further defined herein. The exact amount of the detergent composition carried by the substrate depends upon the particular substrate materials and active materials included in the composition. Preferred articles carry from about 3 to about 120, preferably from about 20 to about 80, grams of the detergent composition. The detergent composition may be loaded onto the substrate material in any of the ways conventionally known in the art, such as coating or impregnation. Particularly preferred sandwich-type articles are disclosed in U.S. patent application Ser. No. 781,378, Flesher et al, filed Mar. 25, 1977, incorporated herein by reference. In such a preferred embodiment, at least one of the substrate sheets used must have an air permeability of at least about 10 cubic feet per minute per square foot.

The substrates employed herein are water-insoluble and are solid or substantially solid materials. They can be dense or open in structure, preferably the latter. Examples of suitable materials which can be used as a substrate herein include, among others, water-insoluble particulate materials (such as certain silicas, silicon dioxide, clays, and aluminosilicates), foam, foil, sponge, paper, woven cloth, and nonwoven cloth. The term "cloth", as used herein, means a woven or nonwoven fabric or cloth used as a substrate, in order to distinguish it from the term "fabric" which means the textile fabric which is desired to be laundered. Absorbent capacity, thickness, or fiber density are not limitations on the substrates which can be used herein, as long as the substrates exhibit sufficient wet-strength so as to maintain their structural integrity through the complete washing and drying cycles in which they are used. Further, the substrates must have certain thermal stability characteristics, i.e., they should not have a melting point or ignite at temperatures below 300° F., preferably about 425° F., in order to permit their use in automatic clothes dryers. Preferably, the substrates employed herein are wet-strength paper or nonwoven cloth.

Paper substrates which can be employed herein encompass the broad spectrum of known paper structures and are not limited to any specific papermaking fiber or wood pulp. Thus, the fibers derived from soft woods, hard woods, or annual plants (e.g., bagasse, cereal straw, and the like), and wood pulps, such as bleached or unbleached kraft, sulfite, soda ground wood, or mixtures thereof, can be used. Moreover, the paper substrates which can be employed herein are not limited to specific types of paper, as long as the paper exhibits the necessary wet-strength and thermal stability.

A specific example of a paper substrate preferred herein is a two-ply paper having a basis weight of about 50 lbs. per 2,880 sq. ft. made from, for example, a mixture of ground wood and kraft-bleached wood pulps. Another example is the absorbent, multi-ply toweling paper particularly preferred in U.S. Pat. No. 3,686,025, Morton, issued Aug. 22, 1972 and disclosed in U.S. Pat. No. 3,414,459, Wells, said patents being incorporated herein by reference.

The preferred nonwoven cloth substrates used in the invention herein can generally be defined as adhesively bonded fiberous products, having a web or corded fiber structure (where the fiber strength is suitable to allow carding) or comprising fiberous mats, in which the fibers are distributed haphazardly or in a random array (i.e., an array of fibers in a carded web wherein partial orientation of the fibers is frequently present as well as a completely haphazard distributional orientation) or substantially aligned. The fibers can be natural (e.g., wool, silk, jute, hemp, cotton, linen, sisal, or ramie) or synthetic (e.g., rayon, cellulose ester, polyvinyl derivatives, polyolefins, polyamides, or polyesters). Any diameter or denier of the fiber, generally up to about 10 denier, can be used in the present invention.

Methods of making nonwoven cloths suitable for use herein are not a part of this invention and, being well known in the art, are not described in detail herein. Generally, such cloths are made by dry- or water-laying processes in which the fibers are first cut to desired lengths from long strands, passed into a water or air stream, and then deposited onto a screen, through which the fiber-laden air or water is passed. The deposited fibers are then adhesively bonded together, dried, cured, and otherwise treated as desired to form the nonwoven cloth. Nonwoven cloths made of polyesters, polyamides, vinyl resins, and other thermoplastic fibers can be spun bonded, i.e., the fibers are spun out onto a flat surface and bonded (melted) together by heat or by chemical reactions.

When the substrate component of the fabric conditioning/detergent articles herein is a nonwoven cloth made from fibers deposited haphazardly or in a random array on the screen, the compositions exhibit excellent strength in all directions and are not prone to tear or separate when used in both the washer and the dryer.

Preferably, the nonwoven cloth is water-laid or dry-laid and is made from cellulosic fibers, particularly from regenerated cellulose or rayon, which are lubricated with a standard textile lubricant. Preferably, the fibers are from about 3/16" to about 2" in length and are from about 1.5 to about 5 denier. It is also preferred that the fibers are at least partially oriented haphazardly, particularly substantially haphazardly, and are adhesively bonded together with a hydrophobic or substantially hydrophobic binder resin, particularly with a nonionic self-crosslinking acrylic polymer or polymers. A preferred cloth comprises by weight about 85% fiber and about 15% binder resin polymer, and has a basis weight of from about 50 to about 90 grams per square yard.

The substrates which are used in the detergent articles herein, can take a variety of forms. For example, the substrate can be in the form of a particulate solid, pad, ball or puff or it can be a sheet or swatch of woven or nonwoven cloth. When the substrate is paper or nonwoven, individual sheets of desired length and width can be used, or a continuous roll of desired width from which a measured length is torn off, may be employed.

The substrates used in the present invention may be formed such that they have slit or aperture openings, in order to improve their functioning in the automatic dryer. Such openings are described in U.S. Pat. No. 3,944,694, McQueary, issued Mar. 16, 1976; U.S. Pat. No. 3,956,556, McQueary, issued May 11, 1976; U.S. Pat. No. 4,007,300, McQueary, issued Feb. 8, 1977; and U.S. Pat. No. 4,012,540, McQueary, issued Mar. 15, 1977, all of which are incorporated herein by reference.

The substrates usable herein can be "dense", or they can be open and have a high amount of "free space". Free space, also called "void volume", is that space within a substrate structure which is unoccupied. For example, certain absorbent, multi-ply paper structures comprise plies embossed with protuberances, the ends of which are mated and joined. This paper structure has free space between the unembossed portions of the plies, as well as between the fibers of the paper plies themselves. A nonwoven cloth also has such space among its fibers. The free space of the substrate can be varied by modifying the density of the fibers of the substrate. Substrates with a high amount of free space generally have low fiber density, and substrates having high fiber density generally have a low amount of free space.

The amount of free space which a material has is not essential to its employment as a substrate herein. However, the amount of free space in the substrate structure may affect the amount of the surfactant and fabric conditioning components which must be applied to the substrate in order to achieve a desired leading effect.

The detergent composition carried by this substrate comprises from about 5 to about 95%, preferably from about 10 to about 90%, and most preferably from about 15 to about 85%, a mixture of specifically defined nonionic and cationic surfactants. The ratio of nonionic surfactant to cationic surfactant used in these mixtures is in the range of from about 5:3 to about 300:1, preferably from about 5:3 to about 100:1, most preferably from about 5:3 to about 50:1. Particularly preferred ratios are from about 5:3 to about 10:1, preferably from about 5:3 to about 5:1, particularly about 5:2.

Nonionic Surfactant

Conventional nonionic surfactants, well known in the detergency arts, and preferably those having HLB's from about 5 to about 17, may be used in the articles of the present invention. These surfactants may be included either singly or in mixtures, and are preferably used in combination with the preferred alcohol ethoxylate nonionic surfactants, described hereinafter. Examples of such surfactants are listed in U.S. Pat. No. 3,717,630, Booth, issued Feb. 20, 1973, and U.S. Pat. No. 3,332,880, Kessler et al, issued July 25, 1967, each of which is incorporated herein by reference. Non-limiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, di-isobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol; and di-isooctyl phenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants of this type include Tergitol 15-S-9, marketed by Union Carbide Corporation, Neodol 45-9, marketed by Shell Chemical Company, and Kyro EOB, marketed by The Procter & Gamble Company.

(3) The condensation products of ethylene oxide with a hydrophobic base formed by the condensation of propylene oxide with propylene glcol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic surfactants, marketed by Wyandotte Chemical Corporation.

(4) The condensation products of ethylene oxide with the product resulting from the reaction of propylene oxide and ethylene diamine. The hydrophobic moiety of these products consists of the reaction product of ethylene diamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds, marketed by Wyandotte Chemical Corporation.

A preferred group of nonionic surfactants useful herein comprises a mixture of "surfactant" and "cosurfactant", containing at least one nonionic surfactant falling within the definition, of nonionic surfactants useful in the present invention, as described in U.S. patent application Ser. No. 557,217, Collins, filed Mar. 10, 1975, now abandoned, the disclosure of which is incorporated herein by reference.

Preferred nonionic surfactants used in the compositions of the present invention are biodegradable and have the formula $R(OC_2H_4)_nOH$, wherein R is a primary or secondary alkyl chain of from about 8 to about 22, preferably from about 10 to 20, carbon atoms, and n is an average of about 2 to about 9. The surfactants have an HLB (hydrophilic-lipophilic balance) of from about 5 to about 17, preferably from about 6 to about 15. HLB is defined in detail in *Nonionic Surfactants*, by M. J. Schick, Marcel Dekker, Inc., 1966, pages 607–613, incorporated herein by reference. In preferred nonionic surfactants, n is from 4 to 7.

Particularly preferred nonionic surfactants for use in the articles of the present invention include the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12-13}$ alcohol with 6.5 moles of ethylene oxide, and the same condensation product which is stripped so as to remove substantially all lower ethoxylate and non-ethoxylated fractions; the condensation product of $C_{12-13}$ alcohol with 3 moles of ethylene oxide which is stripped so as to remove the lower ethoxylate and nonethoxylated fractions; the condensation product of $C_{14-15}$ alcohol with 2.25 moles of ethylene oxide; and the condensation product of $C_{14-15}$ alcohol with 7 moles of ethylene oxide.

Where the present invention contains a mixture of a preferred alcohol ethoxylate nonionic surfactant (or surfactants) together with other types of nonionic surfactants, the ratio of the preferred surfactant (or surfactants) to the remaining nonionic surfactants is preferably within the range of from about 1:1 to about 5:1. Specific examples of surfactant mixtures useful in the present invention include a mixture of the condensation product of $C_{14-15}$ alcohol with 3 moles of ethylene oxide (Neodol 45-3) and the condensation product of $C_{14-15}$ alcohol with 9 moles of ethylene oxide (Neodol 45-9), in a ratio of lower ethoxylate nonionic to higher ethoxylate nonionic of from about 1:1 to about 3:1, a mixture of the condensation product of $C_{10}$ alcohol with 3 moles of ethylene oxide together with the condensation product of a secondary $C_{15}$ alcohol with 9 moles of ethylene oxide (Tergitol 15-S-9), in a ratio of lower ethoxylate nonionic to higher ethoxylate nonionic of from about 1:1 to about 4:1; a mixture of Neodol 45-3 and Tergitol 15-S-9, in a ratio of lower ethoxylate nonionic to higher ethoxylate nonionic of from about 1:1 to about 3:1; and a mixture of Neodol 45-3 with the condensation product of myristyl alcohol with 10 moles of ethylene oxide, in a ratio of lower ethoxylate to higher ethoxylate of from about 1:1 to about 3:1.

Preferred nonionic surfactant mixtures contain alkyl glyceryl ether compounds together with the preferred alcohol ethoxylate nonionic surfactant. Particularly preferred are glyceryl ethers having the formula $$R-O(CH_2CH_2O)_nCH_2\underset{\underset{OH}{|}}{C}HCH_2OH$$

wherein R is an alkyl or alkenyl group of from about 8 to about 18, preferably about 8 to 12, carbon atoms or an alkaryl group having from about 5 to 14 carbons in the alkyl chain, and n is from 0 to about 6, together with one of the preferred alcohol ethoxylate nonionic surfactants, defined above, in a ratio of alcohol ethoxylate to glyceryl ether of from about 1:1 to about 4:1, particularly about 7:3. Glyceryl ethers of the type useful in the present invention are disclosed in U.S. patent application Ser. No. 644,214, Jones, filed Dec. 24, 1975; and U.S. Pat. No. 4,098,713, Jones, issued July 4, 1978; both of which are incorporated herein by reference.

Cationic Surfactant

The cationic surfactants used in the detergent compositions incorporated into the substrate articles of the present invention have the formula $$R^1{}_mR^2{}_xY_LZ$$

wherein each $R^1$ is an organic group containing a straight or branched alkyl or alkenyl group optionally substituted with up to 3 phenyl groups and optionally interrupted by up to 4 of the following functional groups:

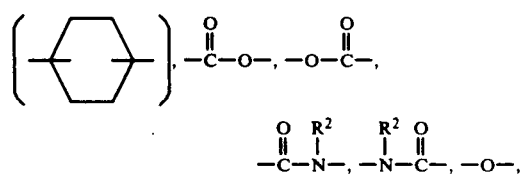

and mixtures thereof, and which contains from about 8 to 22 carbon atoms, and which may additionally contain up to 20 ethoxy groups, and m is a number from one to seven. No more than one $R^1$ in a molecule can have more than 12 carbon atoms when m is 3 or greater. In preferred surfactants, no more than one $R^1$ in a molecule can have more than 16 carbon atoms when m is 2 or greater. $R^2$ is an alkyl or hydroxy-alkyl group containing from 1 to 4 carbon atoms or a benzyl group with no more than one $R^2$ in a molecule being benzyl, and x is a number from 0 to 7. The remainder of any carbon, nitrogen, sulfur or phosphorus atom positions on the Y group are filled by hydrogens. Y is selected from the group consisting of:

(1) 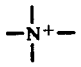

(2) 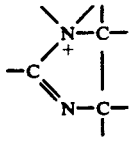

(3) 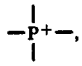

(4) 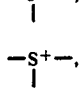

(5) 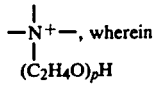 , wherein p is from 1 to 20, (6) 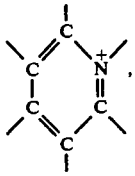

(7) 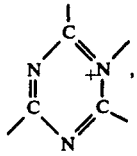 , and mixtures thereof, (8)

L is a number from 1 to 3, and Z is a water-soluble anion, such as a halide, methylsulfate, hydroxide, or nitrate anion, particularly preferred being chloride, bromide or iodide anions, in a number to give electrical neutrality of the cationic component. The specific cationic component to be included in a given system depends to a large extent upon the particular nonionic component to be included in the system, and is selected such that it is at least water-dispersible, or preferably water-soluble, when mixed with said nonionic surfactant. The term "water-dispersible" means that the cationic and nonionic surfactants, as well as any anionic components included in the composition, remain dispersed throughout the laundry solution during the washing process. Mixtures of the above-defined cationic materials may also be used in the compositions of the present invention. Small amounts of other cationic materials can be tolerated in such mixtures.

In preferred cationic materials, L is equal to 1 and Y is

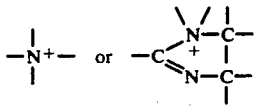

or mixtures thereof. However, L may be greater than 1, such as in cationic components containing 2 or 3 cationic charge centers. Other cationic materials which are useful in the compositions of the present invention include phosphonium, and sulfonium materials.

Where m is equal to 1, it is preferred that x is equal to 3 and $R^2$ is a methyl group. Preferred compositions of this mono-long chain type include those in which $R^1$ is a $C_{10}$ to $C_{20}$ alkyl group. Particularly preferred compositions of this class include $C_{12}$ alkyl trimethylammonium halide and $C_{14}$ alkyl trimethylammonium halide.

In order to be sufficiently water-soluble or water-dispersible, the cationic surfactant must satisfy the following chain-length criteria. Where m is equal to 3 or greater, only one of the $R^1$ chains can be greater than 12 carbon atoms in length. In this instance, it is preferred that x is equal to 1 and that $R^2$ is a methyl group. In these compositions it is preferred that $R^1$ is a $C_8$ to $C_{11}$ alkyl group. Particularly preferred tri-long chain cationics include trioctylmethylammonium halide, and tridecylmethylammonium halide.

A particularly preferred type of cationic component, which is described in U.S. patent application Ser. No. 811,218, Letton, filed June 29, 1977, and incorporated herein by reference, has the formula $$R^2-(Z^1)_a-(R^3)_n-Z^2-(CH_2)_m-\overset{R^1}{\underset{R^1}{N^+}}-R^1\,X^-$$

wherein $R^1$ is $C_1$ to $C_4$ alkyl or hydroxyalkyl; $R^2$ is $C_5$ to $C_{30}$ straight or branched chain alkyl or alkenyl, alkyl phenyl, or $$X^-\,R^1-\overset{R^1}{\underset{R^1}{{}^+N}}-(CH_2)_s-;$$

wherein s is from 0 to 5; $R^3$ is $C_1$ to $C_{20}$ alkyl or alkenyl; a is 0 or 1, n is 0 or 1, and a is 1 only when n is 1; m is from 1 to 5; $Z^1$ and $Z^2$ are each selected from the group consisting of $$-\overset{O}{\overset{\|}{C}}-O-,\ -O-\overset{O}{\overset{\|}{C}}-,\ -O-,\ -O-\overset{O}{\overset{\|}{C}}-O-,\ -\overset{O}{\overset{\|}{C}}-\overset{H}{N}-,$$
$$-\overset{H}{N}-\overset{O}{\overset{\|}{C}}-,\ -O-\overset{O}{\overset{\|}{C}}-\overset{H}{N},\ -\overset{H}{N}-\overset{O}{\overset{\|}{C}}-O-,$$

and mixtures thereof, and wherein at least one of said groups is an ester, reverse ester, amide or reverse amide; and X is an anion which makes the compound at least water-dispersible, preferably selected from the group consisting of halide, methyl sulfate, and nitrate, preferably chloride, bromide or iodide.

In addition to the advantages of the other cationic surfactants disclosed herein, this particular cationic component is environmentally desirable, when its $R^2$ chain is not highly branched, since it is biodegradable, yielding environmentally acceptable compounds, both in terms of its long alkyl chain and its nitrogen-containing segment.

Particularly preferred cationic surfactants of this type are the choline ester derivatives having the following formula:

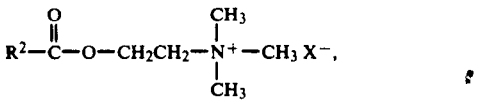

as well as those wherein the ester linkage in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{15}$ alkyl), myristoyl choline ester quaternary ammonium halides ($R^2=C_{13}$ alkyl), lauroyl choline ester ammonium halides ($R^2=C_{11}$ alkyl), and tallowyl choline ester quaternary ammonium halides ($R^2=C_{15}$–$C_{17}$ alkyl).

Additional preferred cationic components of the choline ester variety are given by the structural formulas below, wherein p may be from 0 to 20.

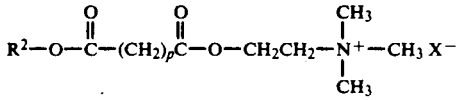

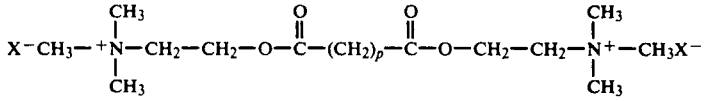

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length together with 2-haloethanol, in the presence of an acid catalyst material. The reaction product is then used to quaternize trimethylamine, forming the desired cationic component.

Another type of preferred biodegradable cationic surfactant for use in the articles of the present invention has the formula

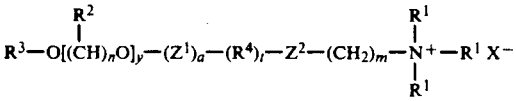

In the above formula, each $R^1$ is a $C_1$ to $C_4$ alkyl or hydroxyalkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenylene, alkyl phenyl, or alkyl benzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1, t may be 0 or 1, and a can be 1 only when t is 1; and m is from 1 to 5, preferably 2. $Z^1$ and $Z^2$ are each selected from the group consisting of:

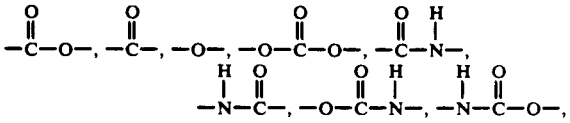

and mixtures thereof, and wherein at least one of said groups is selected from the group consisting of ester, reverse ester, amide, and reverse amide. X is an anion which will make the compound at least water-dispersible, and is selected from the group consisting of halides, methyl sulfate, and nitrate, particularly chloride, bromide and iodide. Mixtures of the above structures can also be used.

The above types of preferred surfactants, when used in the compositions of the present invention, yield excellent particulate soil, body soil, and greasy/oily soil removal. In addition, the detergent compositions control static and soften the fabrics laundered therewith, and inhibit the transfer of certain dyes in the washing solution. Further, these novel cationic surfactants are environmentally desirable, as long as the molecules do not contain highly branched segments, since both their long chain alkyl segments and their nitrogen segments are biodegradable, in that they degrade to yield environmentally acceptable compounds. Where this type of biodegradable cationic surfactant is used, it is preferred that the detergent compositions have a pH of not greater than about 11, preferably less than about 10, in the laundry solution, in order to minimize hydrolysis of the cationic surfactant. This hydrolysis may also be minimized by using the alkalinity sources defined in concurrently filed U.S. patent application Ser. No. 864,135, Kingry, incorporated herein by reference.

Preferred embodiments of this type of cationic component are the choline esters ($R^1$ is a methyl group and $Z^2$ is an ester or reverse ester group), particular formulas of which are given below, in which t is 0 or 1, y is from 1 to 20, and $R^3$ and X are as defined above.

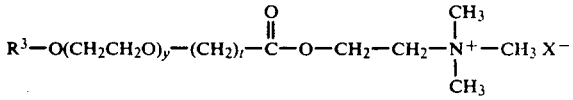

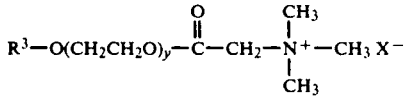

-continued

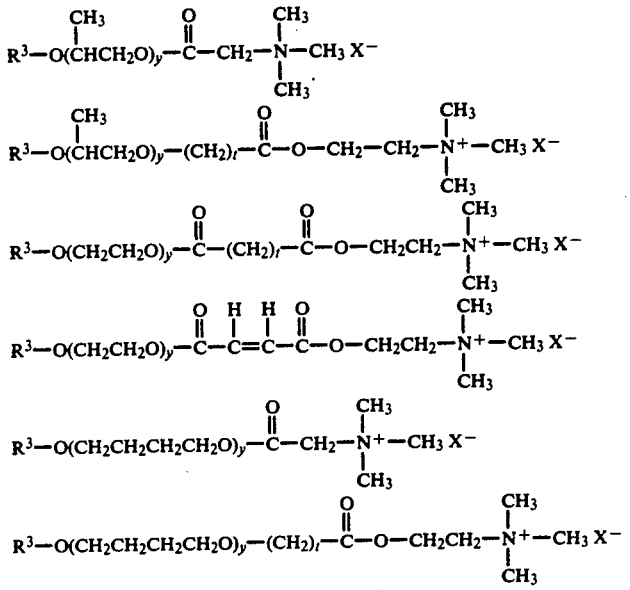

The preferred choline derivatives, described above, may be prepared by the reaction of a long chain alkyl polyalkoxy (preferably polyethoxy) carboxylate, having an alkyl chain of desired length, with oxalyl chloride, to form the corresponding acid chloride. The acid chloride is then reacted with dimethylaminoethanol to form the appropriate amine ester, which is then quaternized with a methyl halide to form the desired choline ester compound. Another way of preparing these compounds is by the direct esterification of the appropriate long chain ethoxylated carboxylic acid together with 2-haloethanol or dimethyl aminoethanol, in the presence of heat and an acid catalyst. The reaction product formed is then quaternized with methylhalide or used to quaternize trimethylamine to form the desired choline ester compound.

Solubilization Aid

The compositions used in the articles of the present invention additionally contain from about 1 to about 30%, preferably from about 3 to about 25%, and most preferably from about 5 to about 20%, of specifically selected solubilization aid components. These components should be non-ionic or cationic in nature, in order to be compatible with the nonionic/cationic surfactant mixture, and must have a solubility in 100° F. water of at least about 20%, and preferably at least about 25%, by weight. In addition, the solubilization components must be selected such that they completely dissolve in 100° F. water in no more than about 2 minutes, and preferably no more than about 1 minute. In order to achieve the proper release of the active components from the substrate carrier, it is necessary that the solubilization aid which is chosen satisfy both of the above solubility criteria. Thus, sodium chloride, which is highly soluble, thereby satisfying the first criterion, does not have a sufficiently rapid rate of solubility to satisfy the second criterion, and therefore it is not satisfactory for use in the articles of the present invention. These solubilization aids, and their use in laundry substrate articles, are described in concurrently filed U.S. patent application Ser. No. 864,050, Cambre, incorporated herein by reference.

Although not wishing to be bound by theory, it is believed that as the solubilization component rapidly dissolves in the laundry solution, the surface area at the interface between the laundry solution and the cationic/nonionic surfactant mixture is increased, thus enhancing the dissolution of the mixture from the substrate into the washing system. Preferred solubilization aids are those selected from the group consisting of choline chloride, ammonium chloride, phenylmethylammonium chloride, sucrose, glucose, polyethylene glycol having a molecular weight of from about 1,000 to about 6,000, preferably about 4,000, and mixtures of those materials. Particularly preferred solubilization materials are choline chloride, sucrose, glucose, polyethylene glycol having a molecular weight of from about 1,000 to about 6,000, preferably about 4,000, and mixtures thereof. Solubilization aids which satisfy the above solubility criteria and, in addition, are hygroscopic, such as choline chloride, are particularly preferred for use in the articles of the present invention.

The detergent compositions used in the substrate articles of the present invention additionally contain from about 2 to about 20%, preferably from about 5 to about 17%, and most preferably from about 5 to about 15%, of a clay, silica, amide or soap material having an average particle size of no greater than about 3.0 microns. Preferred components are silicas, clays, and mixtures of those materials. It has been found that when these materials, having the particle sizes stated herein, are included in the detergent compositions used in the present invention, the undesirable bleeding of the active components through the substrate materials, during storage, is minimized. It is advantageous to minimize such bleeding, since it may result in a loss of active material, as well as appearance and handling negatives to the user. Preferred anti-bleeding materials are those having an average particle size of no greater than about 2.5 microns, most preferably no greater than about 2 microns. Particularly preferred materials of this type include Zeosyl 200, a silica material having an average agglomerated particle size of about 2 microns, commercially available from J. M. Huber Corporation; Bentone 27, a bentonite clay material having an average particle size of about 0.8 microns, commercially available from N. L. Industries; Quso G30, a silicate material having an average particle size of about 1 to 2 microns and a surface area of about 300 sq.m./g., commercially available from Philadelphia Quartz Company; and mixtures of these materials. Sodium stearate and ammonium stearate are examples of soaps useful as anti-bleeding agents in the present invention, while myristamide and behenamide are examples of amides which may be used. It is necessary that when these thickener materials are used in the articles of the present invention, that they be included together with the solubilization aids, defined above, in order to have sufficiently rapid release of the thickened detergent composition into the laundry solution.

In particularly preferred embodiments of the present invention, the detergent composition contained in the article additionally contains from about 2 to about 25%, preferably from about 2 to about 16%, and most preferably from about 3 to about 10% of a fatty amide surfactant. In relation to the nonionic/cationic surfactant system, the ratio of the cationic/nonionic mixture to the amide component in the composition is in the range of from about 5:1 to about 50:1, preferably from about 8:1 to about 25:1. The addition of the amide component results in excellent particulate soil removal performance, as well as improved soil antiredeposition characteristics, and the development is described in U.S. patent application Ser. No. 811,419, Cambre, filed June 29, 1977, and incorporated herein by reference.

The compositions of the present invention may also contain additional ingredients generally found in laundry detergent compositions, at their conventional art-established levels, as long as these ingredients are compatible with the nonionic and cationic components. For example, the compositions may contain up to about 15%, preferably up to about 5%, and most preferably from about 0.1% to about 2% of a suds suppressor component. Typical suds suppressors include long chain fatty acids, such as those described in U.S. Pat. No. 2,954,347, issued Sept. 27, 1960, St. John, and combinations of certain nonionics therewith as disclosed in U.S. Pat. No. 2,954,348, issued Sept. 27, 1960, Schwoeppe, both disclosures being incorporated herein by reference. Other suds suppressor components useful in the compositions of the present invention include, but are not limited to, those described below.

Preferred suds suppressing additives are described in U.S. Pat. No. 3,933,672, issued Jan. 20, 1976, Bartolotta et al., incorporated herein by reference, relative to a silicone suds controlling agent. The silicone material can be represented by alkylated polysiloxane materials such as silica aerogels and xerogels and hydrophobic silicas of various types. The silicone material can be described as a siloxane having the formula:

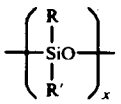

wherein x is from about 20 to about 2,000, and R and R' are each alkyl or aryl groups, especially methyl, ethyl, propyl, butyl and phenyl. The polydimethylsiloxanes (R and R' are methyl) having a molecular weight within the range of from about 200 to about 200,000, and higher, are all useful as suds controlling agents. Additional suitable silicone materials wherein the side chain groups R and R' are alkyl, aryl, or mixed alkyl and aryl hydrocarbyl groups exhibit useful suds controlling properties. Examples of such ingredients include diethyl-, dipropyl-, dibutyl-, methylethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. patent application Ser. No. 622,303, Gault et al, filed Oct. 14, 1975, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole percent of dialkyl phosphate and up to about 5 mole percent of trialkyl phosphate.

Other adjunct components which may be included in the articles of the present invention, in their conventional art-established levels for use (i.e., from 0 to about 40%), include anionic, zwitterionic and ampholytic cosurfactants, detergency builders, bleaching agents, bleach activators, soil-suspending agents, corrosion inhibitors, dyes, fillers, optical brighteners, germicides, pH adjusting agents, enzymes, enzyme-stabilizing agents, perfumes, fabric softening components, static control agents, and the like. However, because of the numerous and diverse performance advantages of the articles of the present invention, certain types of components, such as detergency builders, static control agents, fabric softening agents and germicides, may not be necessary in a particular formulation.

Examples of cosurfactants and detergency builders, which may be used in the compositions of the present invention, are found in U.S. Pat. No. 3,717,630, Booth, issued Feb. 20, 1973, and U.S. patent application Ser. No. 811,220, Murphy, filed June 29, 1977, both of which are incorporated herein by reference. However, these components, particularly anionic surfactants, should be checked with the particular cationic/nonionic surfactant system used, in order to ascertain whether they are compatible.

The use of the substrate articles of the present invention provides a convenient and efficient method whereby soiled fabrics may be cleaned. The substrate article (or articles) is placed in an automatic washing machine together with the fabrics to be laundered, preferably at the start of the washing cycle, and is allowed to remain there until the washing cycle is completed. During this process, which includes the agitation of the laundry solution, the surface-active compositions and the other fabric conditioning components which are contained in the substrate article are rapidly and completely released into the washing solution and provide cleaning and other benefits to the fabrics washed therein. If the substrate article additionally contains any dryer-activated fabric conditioning components, such as those described in U.S. Pat. No. 4,095,946, Jones et al, issued June 20, 1978, and U.S. Pat. No. 4,113,630, Hagner et al, issued Sept. 12, 1978, both of which are incorporated herein by reference, the washed fabrics and the substrate article are placed in an automatic dryer, where they are subjected to the heated drying cycle. In the course of this drying operation, the dryer-activated fabric conditioning components are released, providing additional benefits to the laundered fabrics.

All percentages, parts, and ratios used herein are by weight unless otherwise specified.

The following nonlimiting examples illustrate the compositions and method of the present invention.

EXAMPLE I

The ability of various substrate articles to release active components into a laundry solution was tested in the following manner. Detergent compositions, having the formulations stated below, were prepared by mixing together the ingredients in the proportions given.

| Composition | Components | Weight % |
|---|---|---|
| A | $C_{17}H_{35}-\overset{\overset{O}{\|}}{C}-O-CH_2CH_2-\overset{\overset{CH_3}{\|}}{\underset{\underset{CH_3}{\|}}{N^+}}-CH_3\ Cl^-$ | 26.6 |
| | Condensation product of coconut alcohol with 5 moles of ethylene oxide | 52.5 |
| | Ammonia amide | 7.4 |
| | Borax . 10 $H_2O$ | 13.5 |
| B | Same as A, above, plus Choline chloride (6.4 grams) | ~10% |
| C | Same as A, above, plus Choline chloride (9.6 grams) | ~13% |
| D | Same as A, above, plus Zeosyl 200 (3.4 grams) | ~5% |
| E | Same as A, above, plus Zeosyl 200 (3.4 grams) | ~4.5% |
| | Choline chloride (7.1 grams) | ~9.5% |
| F | Same as A, above, plus Bentone 27 (10.1 grams) | ~13.5% |
| G | Same as A, above, plus Bentone 27 (10.1 grams) | ~12% |
| | Choline chloride (7.5 grams) | ~9% |

Detergent articles were made with each of these compositions by spreading about 65 grams of the composition on one side of an 8"×11" sheet of a Scott 8050 Industrial Towel, having an air permeability of about 130 cu. ft./min./sq. ft., a basis weight of about 77.5 grams per square yard, and a thickness of 44 mils. An identical sheet of the paper towel was placed on top of the coated side of the original sheet, and the edges were sewn together so as to enclose the composition within the article. Pairs of the articles were then placed in a Kenmore automatic washing machine together with a 5½ to 6 pound mixed fabric load. The washer was run through a gentle agitation wash cycle, using 22 gallons of 80° F. water (Cincinnati city water—8–10 grains per gallon of mixed hardness), with a cold water rinse. At the conclusion of the washing operation, the substrate articles were removed and the amount of active material released from the article was visually estimated. The table below summarizes the data obtained.

| Run | Compositions | % Active Dissolved from Article (Visually Estimated) |
|---|---|---|
| I | A | 20% |
| | B | 95% |
| II | A | 10% |
| | C | 95% |
| III | D | 10% |
| | E | 80% |
| IV | F | 10% |
| | G | 80% |

These data demonstrate the dramatic increase in the rate and completeness of release of the detergent composition from the substrate article, obtained where the solubilization aids of the present invention are used.

Substantially similar component release results are obtained where the choline chloride solubilization aid, in the above formulations, is replaced, in whole or in part, by equivalent amounts of ammonium chloride, phenyl methyl ammonium chloride, sucrose, glucose, polyethylene glycol having a molecular weight of from about 1,000 to about 6,000, particularly about 4,000, or mixtures of those components.

Similar results are also obtained where the nonionic component, used above, is replaced by the condensation product of $C_{10}$ alcohol with three moles of ethylene oxide, the condensation product of coconut alcohol with six moles of ethylene oxide, the condensation product of coconut alcohol with seven moles of ethylene oxide, the condensation product of $C_{12-13}$ alcohol with 6.5 moles of ethylene oxide, the condensation product of $C_{14-15}$ alcohol with seven moles of ethylene oxide, or the condensation product of $C_{12-13}$ alcohol with three moles of ethylene oxide stripped so as to remove the lower ethoxylate and unethoxylated fractions.

Excellent results are also obtained where the detergent compositions used contain nonionic to cationic surfactant ratios of about 100:1, 70:1, 50:1, 35:1, 25:1, 20:1, 15:1, 10:1, 5:1, 4:1, 3:1, 20:7, 20:9, 2:1, or 5:3.

Similar results are also obtained where the nonionic component is replaced by a mixture of the condensation product of $C_{14-15}$ alcohol with three moles of ethylene oxide together with the condensation product of $C_{14-15}$ alcohol with seven moles of ethylene oxide, having a ratio of lower ethoxylate nonionic to higher ethoxylate nonionic of about 2:1, a mixture of the condensation product of $C_{14-15}$ alcohol with 3 moles of ethylene oxide together with the condensation product of myristyl alcohol with 10 moles of ethylene oxide, in a ratio of lower ethoxylate nonionic to higher ethoxylate nonionic of about 1:1; or a mixture of the condensation product of coconut alcohol with five moles of ethylene oxide together with an alkyl glyceryl ether having the formula:

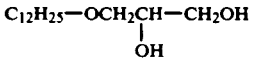

in a ratio of alcohol ethoxylate to glyceryl ether of about 7:3.

Substantially similar release results are also obtained where the cationic component is replaced by $C_{12}$ trimethylammonium chloride, $C_{14}$ trimethylammonium bromide, di-$C_{10}$ dimethylammonium bromide, di-$C_{12}$ dimethylammonium chloride, tri-$C_8$ methylammonium bromide, tri-$C_{10}$ methylammonium chloride, or cationic components having the following formulae:

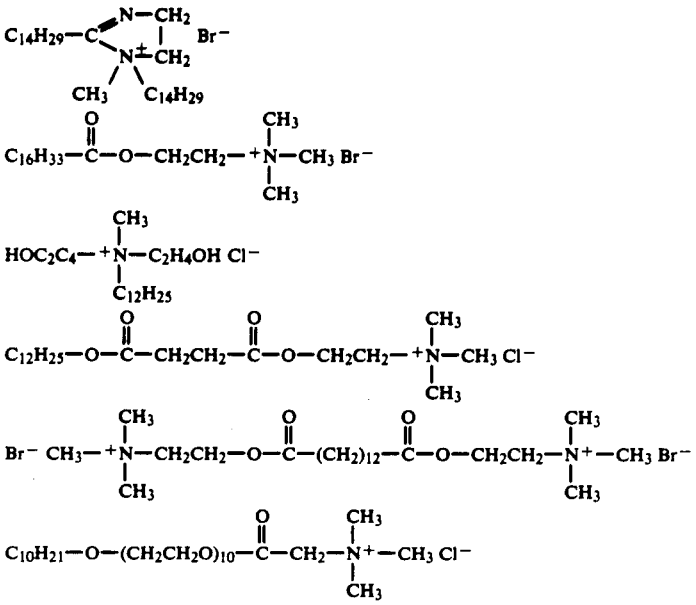

EXAMPLE II

Using the compositions given below, included in the substrate articles in the amounts specified, the release characteristics of several articles of the present invention were examined, using the method and article structure described in Example I, above. The percentage of the total detergent composition released into the laundry solution was calculated by weighing the substrate article before adding it to the washing machine, and then reweighing after it had been used in the washing cycle and dried. The data obtained are summarized in the table below.

| Composition | Component | grams/article | Weight % | % Active Released from Article |
|---|---|---|---|---|
| A | $C_{17}H_{35}-C(=O)-O-CH_2CH_2-{}^{+}N(CH_3)_3\ Cl^-$ | 13.8 | 20.4 | 79.4 |
| | Condensation product of coconut alcohol with 5 moles of ethylene oxide | 29.8 | 43.6 | |
| | Ammonia amide | 4.2 | 6.1 | |
| | Borax . 5 $H_2O$ | 6.0 | 8.8 | |
| | Brightener (anionic) | 0.8 | 1.2 | |
| | Zeosyl 200 | 6.7 | 9.9 | |
| | Choline chloride | 6.8 | 10.0 | |
| B | Same as A, above, except | | | 95.7 |
| | Zeosyl 200 | 6.7 | 8.8 | |
| | Choline chloride | 15.3 | 20.0 | |
| C | Same as A, above, except | | | 70.8 |

-continued

| Composition | Component | grams/article | Weight % | % Active Released from Article |
|---|---|---|---|---|
| | Zeosyl 200 | 4.2 | 6.4 | |
| | Choline chloride | 6.5 | 10.0 | |
| D | Same as A, except | | | 92.0 |
| | Zeosyl 200 | 4.2 | 5.7 | |
| | Choline chloride | 14.7 | 20.0 | |

These data demonstrate the excellent release of detergent components into the laundry solution obtained using the substrate articles of the present invention.

EXAMPLE III

Using the procedure and article structure described in Example I, above, the release of detergent components from the articles, given below, was determined. After the laundering process was completed, the percentage of the active components released from the substrate article was visually estimated, and the results are summarized in the table below.

| Composition | Component | grams/article | Weight % | % Active Released from Article |
|---|---|---|---|---|
| A | $C_{17}H_{35}-\overset{O}{\overset{\|\|}{C}}-O-CH_2CH_2-\overset{CH_3}{\overset{\|}{\underset{CH_3}{\underset{\|}{{}^{+}N}}}}-CH_3\ Cl^-$ | 13.8 | 28.9 | 20 |
| | Condensation product of coconut alcohol with 5 moles of ethylene oxide | 29.8 | 62.5 | |
| | Brightener (anionic) | 0.8 | 1.7 | |
| | Zeosyl 200 | 3.3 | 6.9 | |
| | Choline chloride | — | — | |
| B | Same as A, above, except | | | 90 |
| | Zeosyl 200 | 3.3 | 6.2 | |
| | Choline chloride | 5.3 | 10.0 | |
| C | Same as A, above, except | | | 75 |
| | Zeosyl 200 | 3.3 | 5.5 | |
| | Choline chloride | 11.9 | 20.0 | |

These date demonstrate the excellent release results obtained using the articles of the present invention, as well as the necessity of using the solubilization aids described herein when the articles of the present invention contain components for the minimization of component bleeding.

EXAMPLE IV

The bleeding characteristics of the active components of substrate articles, described below, were tested in the following manner. Detergent compositions having the basic formula given below, but containing various types of anti-bleeding components, were formulated by mixing together the components in the proportions specified. The anti-bleeding materials tested were Zeosyl 200, a silica material having an average agglomerated particle size of about 2 microns; Bentone 27, a bentonite clay material having an average particle size of 0.8 microns; Quso G30, a silicate material having an average particle size of about 1 to 2 microns; and Zeolite A, a sodium aluminosilicate material having an average particle size of about 4 microns.

| Component | Wt. % | grams/article |
|---|---|---|
| $C_{17}H_{35}-\overset{O}{\overset{\|\|}{C}}-O-CH_2CH_2-\overset{CH_3}{\overset{\|}{\underset{CH_3}{\underset{\|}{{}^{+}N}}}}-CH_3\ Cl^-$ | 20.4 | 11.9 |
| Condensation product of coconut alcohol with 5 moles of ethylene oxide | 50.9 | 29.8 |
| Brightener (anionic) | 1.4 | 0.8 |
| Ammonia amide | 7.1 | 4.2 |
| Borax . 5 $H_2O$ | 10.2 | 6.0 |
| Anti-Bleeding Component | 10.0 | 5.8 |

Substrate articles containing each of the above-listed anti-bleeding components were made by coating one side of an 8"×11" sheet of a Scott 8050 Industrial Towel, having an air permeability of about 130 cu. ft./min./sq. ft., a basis weight of about 77.5 grams per square yard, and a thickness of 44 mils, with about 58.5 grams of a given detergent composition. An identical sheet of the paper towel was placed on top of the coated side of the original sheet and the edges were sewn together so as to enclose the composition within the article.

The bleeding characteristics of each article was determined by simulating the storage of a stack of the articles in a cardboard package. Each substrate was placed on top of a piece of cardboard, and had a 4" square Plexiglass block placed on top of it. A 100 gram weight was placed on the Plexiglass block and the substrate was stored at 80° F./60% relative humidity for a two week period. At the end of this storage period, the diameter of the circle of the nonionic component which bled onto the piece of cardboard was measured. A circle having a diameter of greater than 5 inches is considered to be an indication of excessive bleeding under these test conditions. The data obtained are summarized in the table below.

| Thickner | Particle Size (Microns) | Bleeding (Inches) |
|---|---|---|
| Zeosyl 200 | 2.0 | 4.25 |
| Bentone 27 | 0.8 | 3.00 |
| Quso G30 | 1.0–2.0 | 4.25 |
| Zeolite A | 4.0 | 5.75 |

These data demonstrate the advantages, in terms of the minimization of component bleeding, obtained by using the specific types of anti-bleeding agents disclosed in the present application.

Similar results are also obtained where the nonionic component, used above, is replaced, in whole or in part, by the condensation product of $C_{10}$ alcohol with three moles of ethylene oxide, the condensation product of coconut alcohol with six moles of ethylene oxide, the condensation product of coconut alcohol with seven moles of ethylene oxide, the condensation product of $C_{12-13}$ alcohol with 6.5 moles of ethylene oxide, the condensation product of $C_{14-15}$ alcohol with seven moles of ethylene oxide, the condensation product of $C_{12-13}$ alcohol with three moles of ethylene oxide stripped so as to remove the lower ethoxylate and unethoxylated fractions, or mixtures of these surfactants.

Excellent results are also obtained where the detergent compositions included contain nonionic to cationic surfactant ratios of about 100:1, 70:1, 50:1, 40:1, 35:1, 25:1, 15:1, 5:1, 4:1, 10:3, 20:7, 20:9, 2:1, or 5:3.

Similar results are also obtained where the nonionic component is replaced by a mixture of the condensation product of $C_{14-15}$ alcohol with three moles of ethylene oxide together with the condensation product of $C_{14-15}$ alcohol with seven moles of ethylene oxide, in a ratio of lower ethoxylate nonionic to higher ethoxylate nonionic of about 2:1, a mixture of the condensation product of $C_{14-15}$ alcohol with 3 moles of ethylene oxide together with the condensation product of myristyl alcohol with 10 moles of ethylene oxide, in a ratio of lower ethoxylate nonionic to higher ethoxylate nonionic of about 1:1, or a mixture of the condensation product of coconut alcohol with five moles of ethylene oxide together with an alkyl glyceryl ether having the formula:

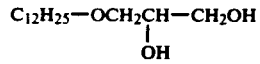

in a ratio of alcohol ethoxylate to glyceryl ether of about 7:3.

Substantially similar results are also obtained where the cationic component is replaced by $C_{12}$ trimethylammonium chloride, $C_{14}$ trimethylammonium bromide, di-$C_{10}$ dimethylammonium bromide, di-$C_{12}$ dimethylammonium chloride, tri-$C_8$ methylammonium bromide, tri-$C_{10}$ methylammonium chloride, or cationic components having the following formulae:

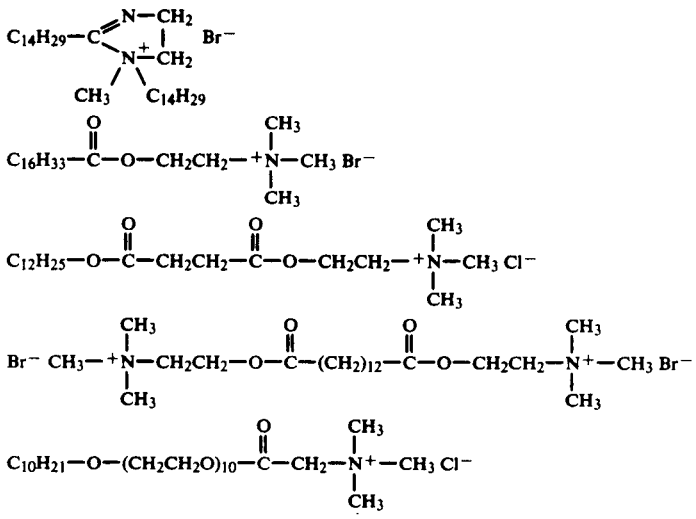

EXAMPLE V

A substrate article, for use in the automatic laundering operation, is made by coating one side of an 8"×11" sheet of Scott 8050 Industrial Towel with about 50 grams of a composition having the formulation given below. The composition is made by intimately mixing the nonionic and cationic surfactants together, at a temperature of about 80° C., to form a thick paste, and then adding the remaining components.

| Component | Wt. % |
|---|---|
| $C_{17}H_{35}-C(=O)-O-CH_2CH_2-N^+(CH_3)_2-CH_3\ Cl^-$ | 25.7 |
| Condensation product of coconut alcohol with 5 moles of ethylene oxide | 50.7 |
| Zeosyl 200 | 9.8 |
| Choline chloride | 11.8 |
| Minors (suds suppressor, perfume, brightener, etc.) | balance to 100 |

An identical sheet of the paper towel is placed on top of the coated side of the original sheet, and the edges are sewn together so as to enclose the composition between the substrate sheets. This article provides a convenient method for introducing the detergent compositions into the laundry solution, and has excellent characteristics in terms of rate of release of the detergent components into the laundry solution and the minimization of component bleeding during storage.

A substrate article may also be made by coating one side of an 11"×11" sheet of melt-blown polypropylene, having a thickness of about 29 mils, a basis weight of about 58.5 grams/sq. yd., and an air permeability of about 66 cu. ft./min./sq. ft., with about 60 grams of the detergent composition described above, placing an identical substrate sheet over the coated sheet, and heat sealing together the edges of the two substrates, enclosing the detergent composition within the article.

EXAMPLE VI

A laundry detergent substrate article of the present invention, containing the detergent composition given below, is made using the procedure taught in Example V, above. This article exhibits excellent cleaning of greasy/oily and particulate soils when used in the automatic washing process, and has excellent component release characteristics and a minimum of component bleeding through the substrate sheets when stored.

| Component | Wt. % |
|---|---|
| $C_{17}H_{35}-\overset{O}{\overset{\|\|}{C}}-O-CH_2CH_2-\overset{CH_3}{\underset{CH_3}{\overset{\|}{\underset{\|}{{}^{+}N}}}}-CH_3\ Cl^-$ | 21.4 |
| Condensation product of coconut alcohol with 5 moles of ethylene oxide | 42.2 |
| Ammonia amide | 5.9 |
| Borax . 10 $H_2O$ | 10.9 |
| Zeosyl 200 | 9.1 |
| Choline chloride | 10.5 |

EXAMPLE VII

A substrate article of the present invention, containing the detergent composition given below, is made according to the procedure outlined in Example V, above. This article gives substantially complete release of the detergent composition from the substrates during a standard automatic laundry cycle, and exhibits minimal bleeding of the surfactant components through the substrate materials during storage. In addition, the article yields excellent cleaning of particulate and greasy/oily soils, as well as providing fabric softening, static control and dye transfer inhibition benefits to fabrics laundered with it.

| Component | Wt. % |
|---|---|
| $C_{12}H_{25}-(C_2H_4O)_7-CH_2-\overset{O}{\overset{\|\|}{C}}-O-C_2H_4-\overset{CH_3}{\underset{CH_3}{\overset{\|}{\underset{\|}{{}^{+}N}}}}-CH_3\ Cl^-$ | 18.3 |
| Condensation product of coconut alcohol with 5 moles of ethylene oxide | 43.7 |
| Lauramide | 4.0 |
| Borax . 5 $H_2O$ | 10.0 |
| Zeosyl 200 | 9.1 |
| Choline chloride | 10.0 |
| Minors (suds suppressor, perfume, brightener, etc.) | balance to 100 |

EXAMPLE VIII

A substrate article of the present invention, containing the detergent composition given below, is formulated using the method described in Example V, above. This article exhibits both excellent release of the detergent composition during an automatic laundering operation, and a minimum of component bleeding during storage.

| Component | Wt. % |
|---|---|
| Dicoconut alkyl dimethylammonium bromide | 19 |
| Condensation product of $C_{14-15}$ alcohol with 7 moles of ethylene oxide | 48 |
| Ammonia amide | 6 |
| Bentone 27 | 10 |
| Choline chloride | 11 |
| Minors (suds suppressor, perfume, brightener, etc.) | balance to 100 |

What is claimed is:

1. A laundry detergent article consisting essentially of a water-insoluble, wet-strength substrate, carrying an effective amount of a detergent composition comprising:

(a) from about 5 to about 95% of a surfactant mixture consisting essentially of;

(i) a nonionic surfactant having an HLB of from about 5 to about 17; and (ii) a cationic surfactant having the formula $R_m{}^1R_x{}^2Y_LZ$, wherein each $R^1$ is an organic group containing a straight or branched alkyl or alkenyl group optionally substituted with up to 3 phenyl groups and, optionally, interrupted by up to 4 structures each of which is selected from the group consisting of

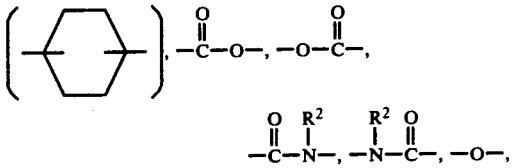

and mixtures thereof, and which contain from about 8 to about 22 carbon atoms, and which may additionally contain up to 20 ethoxy groups, m is a number of from 1 to 7 and no more than one $R^1$ can have more than 12 carbon atoms when m is 3 or greater, each $R^2$ is an alkyl or hydroxy alkyl group containing from 1 to 4 carbon atoms or a benzyl group with no more than one $R^2$ in a molecule being benzyl, x is a number from 0 to 7, the remainder of any carbon, nitrogen, sulfur or phosphorus atoms positions being filled by hydrogens, Y is selected from the group consisting of:

(1) 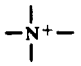

(2) 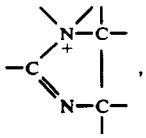

(3) 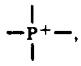

(4) 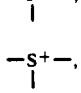

(5) 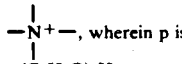 , wherein p is from 1 to 20, (6) 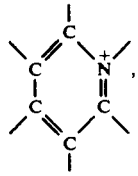

(7) 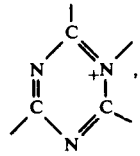 , and (8) mixtures thereof,

L is a number from 1 to 3, Z is an anion in a number sufficient to give electrical neutrality, said cationic surfactant being at least water-dispersible in admixture with said nonionic surfactant; the ratio of said nonionic surfactant to said cationic surfactant being in the range of from about 5:3 to about 300:1; and (b) from about 1% to about 30% of a nonionic or cationic solubilization aid which has a solubility in 100° F. water of at least about 20% by weight, and which completely dissolves in 100° F. water in no more than about 2 minutes; and (c) from about 2 to about 20% of an anti-bleeding material, selected from the group consisting of silicas, clays, amides, soaps, and mixtures thereof, having an average particle size of no greater than about 3.0 microns.

2. The article according to claim 1 wherein the nonionic surfactant has the formula $R(OC_2H_4)_nOH$, wherein R is a primary or secondary alkyl chain of from about 8 to about 22 carbon atoms and n is an average of from about 2 to about 9.

3. The article according to claim 2 wherein the substrate is selected from the group consisting of paper, woven cloth, and nonwoven cloth.

4. The article according to claim 3 wherein said substrate carried from about 3 to about 120 grams of the detergent composition.

5. The article according to claim 4 wherein said anti-bleeding material has an average particle size of no greater than about 2.5 microns.

6. The article according to claim 5 wherein said detergent composition contains from about 5 to about 17% of said anti-bleeding material.

7. The article according to claim 6 wherein said anti-bleeding material is selected from the group consisting of clays, silicas, and mixtures thereof, and has an average particle size of no greater than about 2.0 microns.

8. The article according to claim 7 wherein the detergent composition contains from about 5 to about 15% of said anti-bleeding material.

9. The article according to claim 8 wherein said anti-bleeding material is selected from the group consisting of silica materials having an average particle size of about 2 microns, bentonite clay materials having an average particle size of about 0.8 microns, silicate materials having an average particle size of about 1 to 2 microns, and mixtures of those materials.

10. The article according to claim 9 wherein said anti-bleeding material is a silica material having an average particle size of about 2 microns.

11. The article according to claim 4 wherein said detergent composition contains from about 10 to about 90% of the cationic/nonionic surfactant mixture.

12. The article according to claim 11 wherein said detergent composition contains from about 15 to about 85% of the cationic/nonionic surfactant mixture.

13. The article according to claim 12 wherein the ratio of nonionic surfactant to cationic surfactant is from about 5:3 to about 50:1.

14. The article according to claim 13 wherein, in the nonionic surfactant, R is a $C_{10}$–$C_{20}$ alkyl group.

15. The article according to claim 14 wherein, in the nonionic surfactant, n is from 4 to 7.

16. The article according to claim 13 wherein, in the cationic surfactant, L is 1, Z is an anion selected from the group consisting of halides, methylsulfate, hydroxide, and nitrate, and Y is selected from the group consisting of

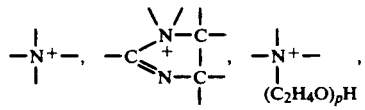

and mixtures thereof.

17. The article according to claim 16 wherein, in the cationic surfactant, Y is

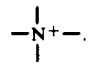

18. The article according to claim 16 wherein the detergent composition contains from about 5 to about 20% of said solubilization aid.

19. The article according to claim 18 wherein said solubilization aid has a solubility in 100° F. water of at least about 25% by weight and completely dissolves in 100° F. water in no more than about 1 minute.

20. The article according to claim 19 wherein said solubilization aid is selected from the group consisting of choline chloride, sucrose, glucose, polyethylene glycol having a molecular weight of from about 1,000 to about 6,000, and mixtures thereof.

21. The article according to claim 17 wherein in the ratio of said nonionic surfactant to said cationic surfactant is from about 5:3 to about 10:1.

22. The article according to claim 21 wherein the ratio of said nonionic surfactant to said cationic surfactant is from about 5:3 to about 5:1.

23. The article according to claim 21 wherein said anti-bleeding material has an average particle size of no greater than about 2.5 microns.

24. The article according to claim 23 wherein said detergent composition contains from about 5 to about 17% of said anti-bleeding material.

25. The article according to claim 24 wherein said anti-bleeding material is selected from the group consisting of clays, silicas, and mixtures thereof, and has an average particle size of no greater than about 2.0 microns.

26. The article according to claim 25 wherein the detergent composition contains from about 5 to about 15% of said anti-bleeding material.

27. The article according to claim 26 wherein said cationic surfactant has the formula

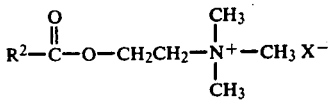

wherein $R_2$ is $C_8$ to $C_{20}$ alkyl and X is an anion selected from the group consisting of halides, methylsulfate, and nitrate.

28. The article according to claim 27 wherein the nonionic surfactant is selected from the group consisting of the condensation product of $C_{10}$ alcohol with 3 moles of ethylene oxide; the condensation product of tallow alcohol with 9 moles of ethylene oxide; the condensation product of coconut alcohol with 5 moles of ethylene oxide; the condensation product of coconut alcohol with 6 moles of ethylene oxide; the condensation product of $C_{12-13}$ alcohol with 6.5 moles of ethylene oxide, and the same condensation product which is stripped so as to remove substantially all lower ethoxylate and nonethoxylated fractions; the condensation product of $C_{12-13}$ alcohol with 3 moles of ethylene oxide which is stripped so as to remove substantially all lower ethoxylated and nonethoxylated fractions; the condensation product of $C_{14-15}$ alcohol with 2.25 moles of ethylene oxide; the condensation product of $C_{14-15}$ alcohol with 7 moles of ethylene oxide; and mixtures thereof.

29. The article according to claim 28 wherein said anti-bleeding material is selected from the group consisting of silica materials having an average particle size of about 2 microns, bentonite clay materials having an average particle size of about 0.8 microns, silicate materials having an average particle size of about 1 to 2 microns, and mixtures of those materials.

30. The article according to claim 29 wherein said anti-bleeding materials is a silica material having an average particle size of about 2 microns.

31. The article according to claim 25 wherein said anti-bleeding material is selected from the group consisting of silica materials having an average particle size of about 2 microns, bentonite clay materials having an average particle size of about 0.8 microns, silicate materials having an average particle size of about 1 to 2 microns, and mixtures of those materials.

32. The article according to claim 31 wherein said anti-bleeding material is a silica material having an average particle size of about 2 microns.

33. A process for laundering fabrics comprising the agitation of said fabrics in an aqueous solution containing the detergent article of claim 4.

34. A laundry detergent article consisting essentially of a water-insoluble, wet-strength substrate, carrying an effective amount of a detergent composition consisting essentially of:

(a) from about 5 to about 95% of a surfactant mixture consisting essentially of:

(i) a nonionic surfactant having an HLB of from about 5 to about 17; and (ii) a cationic surfactant having the formula $R_m{}^1R_x{}^2Y_LZ$, wherein each $R^1$ is an organic group containing a straight or branched alkyl or alkenyl group optionally substituted with up to 3 phenyl groups and, optionally, interrupted by up to 4 structures each of which is selected from the group consisting of

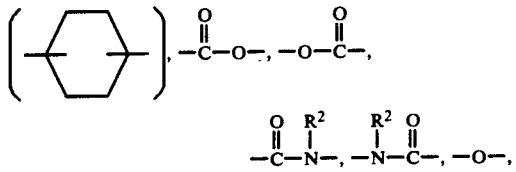

and mixtures thereof, and which contain from about 8 to about 22 carbon atoms, and which may additionally contain up to 20 ethoxy groups, m is a number of from 1 to 7 and no more than one $R^1$ can have more than 12 carbon atoms when m is 3 or greater, each $R^2$ is an alkyl or hydroxy alkyl group containing from 1 to 4 carbon atoms or a benzyl group with no more than one $R^2$ in a molecule being benzyl, x is a number from 0 to 7, the remainder of any carbon, nitrogen, sulfur or phosphorus atom positions being filled by hydrogens, Y is selected from the group consisting of:

(1)

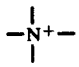

(2)

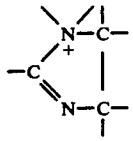

(3)

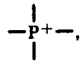

(4)

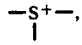

(5)

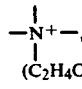 , wherein p is from 1 to 20,

-continued (6)

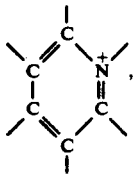

(7)

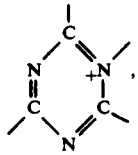

, and mixtures thereof, (8)

L is a number from 1 to 3, Z is an anion in a number sufficient to give electrical neutrality, said cationic surfactant being at least water-dispersible in admixture with said nonionic surfactant; the ratio of said nonionic surfactant to said cationic surfactant being in the range of from about 5:3 to about 300:1;

(b) from about 1% to about 30% of a nonionic or cationic solubilization aid which has a solubility in 100° F. water of at least about 20% by weight, and which completely dissolves in 100° F. water in no more than about two minutes;

(c) from about 2 to about 20% of an anti-bleeding material, selected from the group consisting of silicas, clays, amides, soaps, and mixtures thereof, having an average particle size of no greater than about 3.0 microns;

(d) from 0 to about 25% of a fatty amide surfactant;

(e) from 0 to about 15% of a suds suppressor component; and (f) the balance of said composition being selected from the group consisting of anionic, zwitterionic and ampholytic cosurfactants, detergency builders, bleaching agents, bleach activators, soil suspending agents, corrosion inhibitors, dyes, fillers, optical brighteners, germicides, pH adjusting agents, enzymes, enzyme stabilizing agents, perfumes, fabric softening components, static control agents, and mixtures thereof.

35. The article according to claim 1 wherein, in said cationic surfactant, $R^1$ is selected from the group consisting of:

(a) $C_{12}$–$C_{20}$ alkyl groups, when m equals 1;

(b) $C_{10}$–$C_{20}$ alkyl groups, when m equals 2;

(c) $C_8$–$C_{11}$ alkyl groups, when m equals 3; and (d) mixtures thereof.

36. The article according to claim 35 wherein, in said cationic surfactant, no more than one $R^1$ groups contains greater than 16 carbon atoms when m equals 2.

37. The article according to claim 1 wherein said solubilization aid is selected from the group consisting of choline chloride, ammonium chloride, phenyl methyl ammonium chloride, sucrose, glucose, polyethylene glycol having a molecular weight of from about 1,000 to about 6,000, and mixtures thereof.

* * * * *